US005269098A

United States Patent [19]

Redman

[11] Patent Number: 5,269,098

[45] Date of Patent: Dec. 14, 1993

[54] DOOR WITH FLUID ACTUATOR DOOR OPENING AND CLOSING MECHANISM

[75] Inventor: Carl E. Redman, Lake Oswego, Oreg.

[73] Assignee: Post Industries Incorporated, Portland, Oreg.

[21] Appl. No.: 880,291

[22] Filed: May 4, 1992

Related U.S. Application Data

[63] Continuation of Ser. No. 553,544, Jul. 13, 1990, abandoned.

[51] Int. Cl.[5] ..... E05F 11/00

[52] U.S. Cl. ..... 49/360

[58] Field of Search ..... 49/360, 324, 334, 138

[56] References Cited

U.S. PATENT DOCUMENTS

| | | | |
|---|---|---|---|
| 1,431,413 | 10/1922 | Myers | 49/360 X |
| 3,231,259 | 1/1966 | Bobrowski et al. | 49/360 |
| 3,864,875 | 1/1975 | Hewitt | 49/360 X |
| 3,921,335 | 1/1975 | Hewitt et al. | 49/138 X |
| 3,938,282 | 1/1976 | Goyal | 49/360 X |
| 4,476,678 | 10/1984 | Hall | 49/360 X |
| 4,918,864 | 4/1990 | Lunenschloss et al. | 49/138 X |

FOREIGN PATENT DOCUMENTS

| | | | |
|---|---|---|---|
| 584203 | 6/1956 | Belgium | 49/334 |
| 1265762 | 5/1961 | France | 49/360 |

OTHER PUBLICATIONS

AirGlide TM 81 Series mechanical drawing and schematic drawing by AirTeq.

*Primary Examiner*—Peter M. Cuomo
*Assistant Examiner*—Jerry Redman
*Attorney, Agent, or Firm*—Klarquist, Sparkman, Campbell, Leigh and Whinston

[57] ABSTRACT

A door is supported for shifting between first and second positions, respectively opening and closing a doorway. A fluid actuator, such as a pneumatic cylinder, is used to shift the door between such positions. The fluid actuator reduces the velocity of the door as the door approaches at least one of the open and closed positions. In the case of a pneumatic cylinder, both sides of the cylinder may be subjected to relatively high air pressure when the door is stationary. To reduce the velocity of the door as it approaches the open or closed position, the rate of bleeding of air from one side of the cylinder is reduced.

15 Claims, 3 Drawing Sheets

DOOR OPEN HIGH SPEED
DOOR OPEN LOW SPEED
DOOR CLOSE HIGH SPEED
DOOR CLOSE LOW SPEED
D2
NC
NO
CLOSE REQ.
+24V
COMMON
OPEN REQ.
CLOSED/LOCKED INDICATOR
OPEN/LOCKED INDICATOR

DOOR WITH FLUID ACTUATOR DOOR OPENING AND CLOSING MECHANISM

This application is a continuation of application Ser. No. 07/553,544, filed on Jul. 13, 1990, now abandoned.

BACKGROUND OF THE INVENTION

The present invention relates to a door opening and closing mechanism utilizing a fluid actuator such as a pneumatic cylinder. More specifically, the present invention relates to such a mechanism which may be used in opening and closing very heavy doors, such as sliding doors found in penal institutions, as well as in other applications.

Pneumatic cylinders have been utilized to operate sliding doors in penal institutions. However, existing pneumatic cylinder based systems are subject to a number of drawbacks. In a typical prior art approach, while the door is stationary, pressurized air is not supplied to either side of a piston utilized in shifting the door between open and closed position. Because of this lack of air pressure, each side of the piston is typically at atmospheric pressure (e.g. 14 psi) and the door is not moved. To shift the door, relatively high pressure air (e.g. 100 psi) is applied to one side of the piston while the other side of the piston communicates through a choke orifice to the atmosphere. Upon the application of this high pressure, the door moves relatively rapidly and eventually compresses the air at the low pressure side of the piston, due to the fact that the air cannot escape through the choke orifice very rapidly. This compression of air provides some dampening of door movement as the door approaches the open or closed positions under these conditions. If, however, after moving the door in one direction by pressurizing a first side of the piston it is desired to immediately reverse the direction of door movement, air under pressure is then applied to the opposite or second side of the piston. However, both sides of the piston are then approximately at the relatively high pressure (e.g. 100 psi) because the pressure at the first side of the piston is relieved slowly through the choke orifice. Consequently, the door initially may not move at all in the reverse direction. Thereafter, the door tends to move in the reverse direction very slowly with the velocity of the door being limited by the rate which air bleeds from the first side of the piston through the choke orifice. The door under these condition moves at a relatively constant speed as the bleeding takes place, but not at a rate which is fast enough for the piston to compress air as the door approaches its end position (either open or closed as the case may be). Consequently, in this case the door tends to noisily hit a doorjamb or stop. Also, the noise of air bleeding through choke orifices is significant. In addition, as explained above, it is difficult, if not virtually impossible, to immediately reverse the direction of travel of the door due to the relatively high air pressure at both sides of the piston.

Pivot type doors operated by electric motors are also known to slow down the rate of closing of a door as the door approaches a closed position. However, electrical motor operated sliding doors known to the inventors and used in penal institutions open and close the doors at one speed, and utilize a clutch which slips when the doors hit a stop or doorjamb. Not only do these doors lack fluid actuators and the advantages thereof, they tend to be noisy as well.

Therefore, a need exists for an improved fluid actuator based door operating mechanism and for a door assembly with such a mechanism which is designed to overcome these and other disadvantages of the prior art.

SUMMARY OF THE INVENTION

In accordance with the present invention, a door, such as a sliding door, is mounted to a wall structure for shifting between open and closed positions in which a door opening or doorway through the wall structure is opened and closed by the door. A fluid actuator is coupled to the door and wall structure for shifting the door between the open and closed positions. The fluid actuator, in accordance with one aspect of the present invention, reduces the velocity of the door as the door approaches either or both of the open and closed positions. This reduction in door velocity occurs independently of and regardless of the amount of time between door movement and any reversals in the direction of door movement.

In accordance with another aspect of the invention, the fluid actuator may comprise a pneumatic cylinder having a piston and cylinder housing. An air bleed mechanism is provided for selectively bleeding air from the housing at one side of the piston while air under pressure is supplied to the other side of the piston so as to cause movement of the piston and corresponding door movement. The air bleed mechanism is constructed so as to reduce the rate at which air is bled from the cylinder housing as the door approaches either or both of the open and closed positions.

As a more specific aspect of the present invention, air is bled at a first rate and then at a second rate which is slower than the first rate when the door is a predetermined distance from either or both of the open and closed positions.

In a specific embodiment of the present invention, plural air bleed paths are provided for each of the respective sides of the piston. These air bleed paths are selectively opened to increase or decrease the velocity of the door, with the door velocity being decreased as the door approaches the open or closed positions. Typically plural air bleed flow paths at one side of the piston are opened to increase the velocity of the door while a lesser number of air bleed flow paths (e.g. one) remain open as the door approaches either or both of the open and closed positions. The air bleed flow paths may be of differing cross sectional areas with the cumulative cross sectional area of the air bleed flow paths being greater at times when the door is traveling at higher velocities and lower at times when the door is traveling at a reduced velocity.

As a further aspect of the present invention, the fluid actuator may comprise a pneumatic cylinder having a piston within a cylinder housing and coupled to the door and wall structure for shifting the door between open and closed positions. In accordance with this aspect of the invention, an air delivery means may be provided for supplying pressurized air to the housing at both sides of the piston when the door is stationary. Thus, the door cylinder is prepressurized and ready to move the door in either direction upon the bleeding of the cylinder housing at either of the respective sides of the piston. The door may also be stopped in any position, including at any position between open and closed positions by simply pressurizing both sides of the piston.

The invention also encompasses a fluid actuator type door operating mechanism, operable as described above, alone as well as in combination with a door assembly. In addition, the invention is also directed toward a method of operating a door by which the rate of bleeding of air from a pneumatic cylinder is varied to slow down the velocity of door travel as the door approaches either an open position, a closed position, or both.

It is accordingly one object of the present invention to provide an improved method and apparatus for opening and closing a door.

It is another object of the present invention to provide a door opening and closing method and apparatus which has applicability to a wide variety of applications, including the opening and closing of relatively heavy sliding doors in penal institutions.

Another object of the present invention is to provide a method and apparatus for opening and closing a door which permits the rapid reversal of the direction of movement of the door.

A further object of the present invention is to provide a relatively quiet door opening and closing mechanism utilizing a fluid actuator.

Still another object of the present invention is to provide a door opening and closing mechanism which reduces the velocity of travel of a door as a door approaches either a door open position, a door closed position, or both the open and closed positions.

The invention relates to the above features and objects individually as well as collectively. These and other objects of the present invention will become more apparent with reference to the following detailed description and drawings.

DETAILED DESCRIPTION OF A PREFERRED EMBODIMENT

Figure 1:
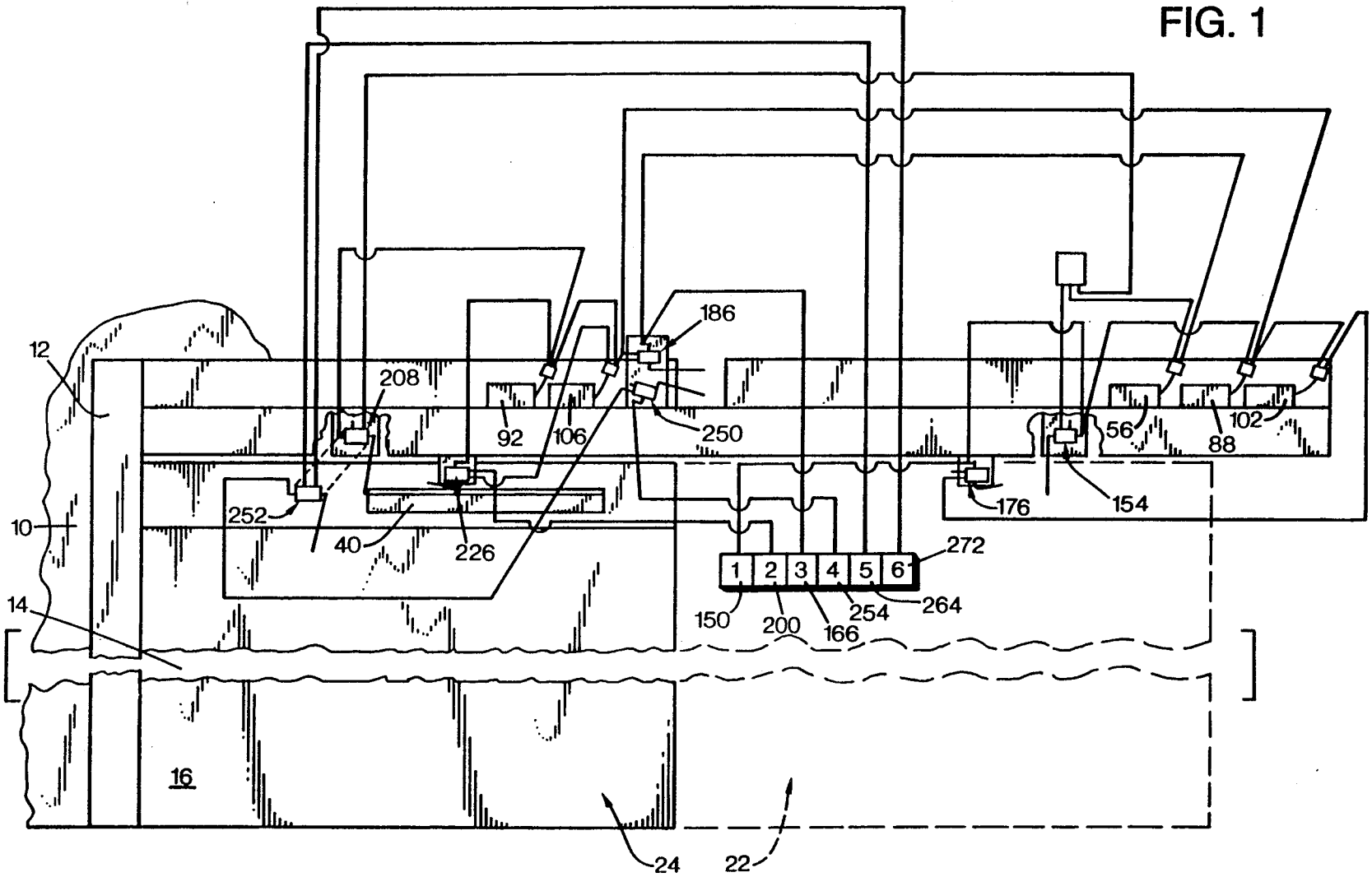
FIG. 1 is a schematic illustration of a door and door operating mechanism in accordance with the present invention.

With reference to FIG. 1, a wall structure 10 is shown along with a portion of a door frame 12 which defines a door opening or doorway indicated generally at 14. Although the present invention is not limited to sliding door applications, it has particular applicability to such applications. Therefore, for purposes of convenience, a door 16 is shown in the doorway. Door 16 may, for example, comprise a heavy door, such as the type utilized in penal institutions weighing from 200 lbs. to 800 lbs. or more. The door is typically suspended from an upper region of the door frame 12 by a conventional sliding support mechanism. One suitable sliding door suspension system for this type of door is described in U.S. patent application Ser. No. 389,839, now U.S. Pat. No. 5,070,575 to Carl Redman, et al. and entitled "Sliding Door Suspension System." This patent application is incorporated herein by reference.

Figure 2:
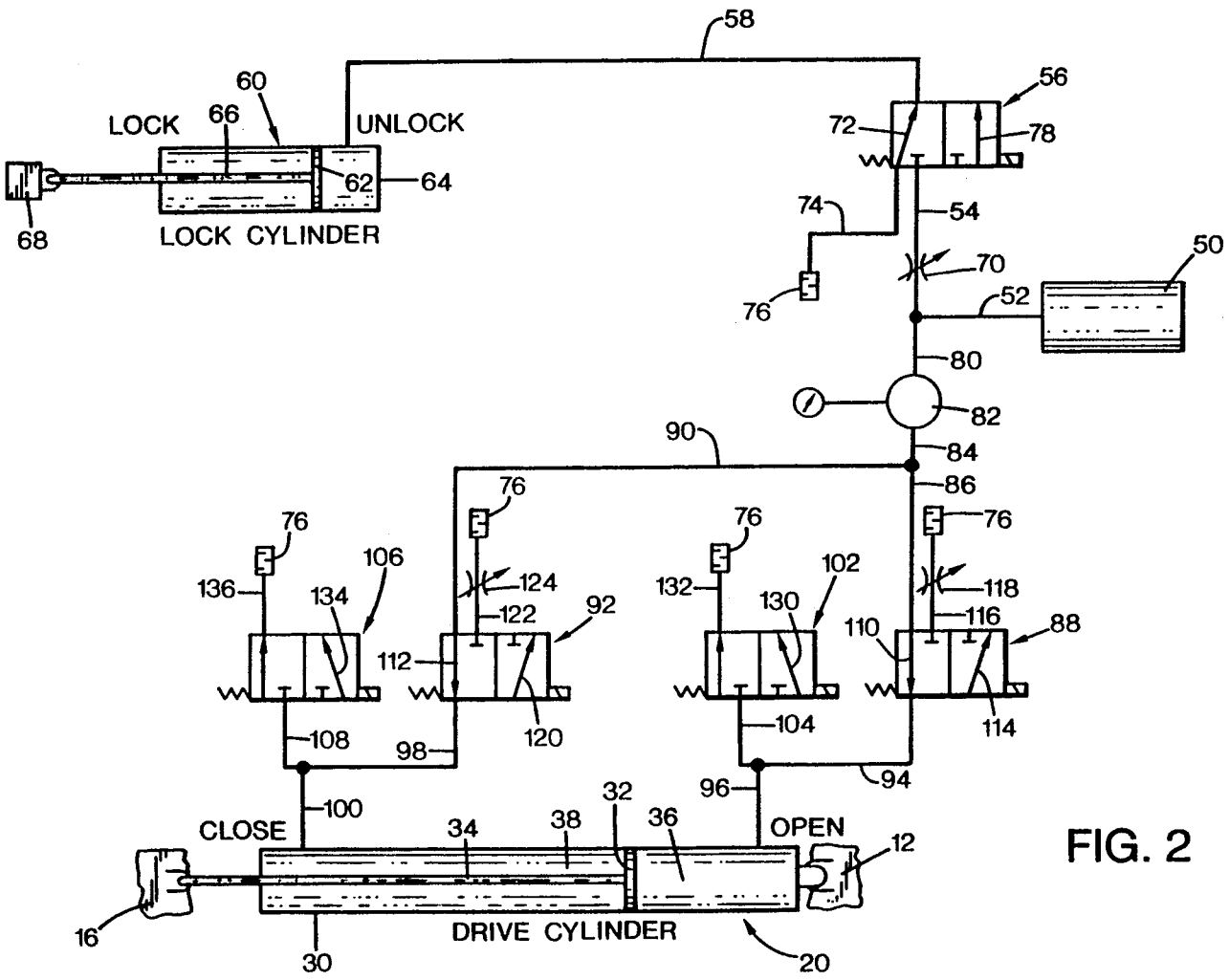
FIG. 2 is a schematic diagram of a fluid circuit utilized in one embodiment of the present invention.

A fluid actuator, not shown in FIG. 1, but indicated at 20 in FIG. 2, is provided for shifting the door between a first open position indicated by the dashed lines which illustrate the door open position 22 in FIG. 1, and a second closed position indicated by the position of the door at 24 in FIG. 1. Although a hydraulic or other type of fluid actuator may be used, the illustrated drive cylinder preferably comprises a pneumatic cylinder with a housing 30 and a piston 32 movable therein. The cylinder housing and piston are coupled in a conventional manner between the door and wall structure, and typically between the door and frame. Equivalently, the cylinder housing and piston may be mounted to extend between the door and a fixed support, whether the support is a part of the wall structure or spaced therefrom. In the depicted embodiment, extension of the fluid actuator, corresponding to movement of piston 32 and its connecting rod 34 to the left in FIG. 2, shifts the door to a closed position. Conversely, in this embodiment the retraction of the piston rod 34, that is movement of piston 32 within the cylinder 30 to the right in FIG. 2, causes a shifting of the door toward the open position. Movement of the piston rod 34 is accomplished by establishing a pressure differential across piston 32. More specifically, raising the pressure within housing 30 at a first side 36 of the piston relative to the pressure within the housing at a second side 38 of the piston causes the extension of the cylinder. Similarly, by increasing the pressure at side 38 of the piston 32 relative to side 36 of the piston, the piston rod is retracted within the cylinder housing and the door is moved accordingly.

Referring again to FIG. 1, a limit switch actuator, such as a projecting bar 40, is mounted to the door 16 for engaging a number of limit switches, as explained below, to control the operation of the door in response to the position of the door within the door opening. Of course, any other suitable control mechanism may also be used, including optical sensors, magnetic sensors, and other types of door position sensors.

In general, as the door approaches the closed position, or the open position, and most preferably both of the closed and open positions, the operation of the drive cylinder 20 is controlled to reduce the velocity of travel of the door. Consequently, the door slows down as it approaches a doorjamb or stop and reduces the noise upon impact. In addition, the jarring associated with abruptly stopping the inertia of an extremely heavy moving door is minimized. In addition, the velocity of the door is slowed even if the door has abruptly reversed its direction of travel.

Although the positioning of various limit switches and components of the electrical control circuit used in the illustrated embodiment of the present invention is shown in FIG. 1, they are more conveniently described in connection with the detailed schematic diagram of FIG. 3. Therefore, the operation of the pneumatic and electrical circuits in controlling the opening and closing of the door will be described with reference to FIGS. 2 and 3. However, the numbering utilized for switches and selected other components shown in FIGS. 2 and 3 has also been used in FIG. 1 so that like components may be readily identified.

With reference to FIG. 2, the pneumatic circuit of the illustrated embodiment of the present invention will be described. As shown in this figure, a supply 50 of air under pressure (e.g. 100 psi) is coupled by a line 52 to a line 54 and then to a solenoid controlled air flow valve 56. The valve 56 is used to control the locking and unlocking of a conventional pneumatic door lock on the door. The valve 56 is coupled by an air line 58 to the housing of a pneumatic lock cylinder 60. A piston 62 within a housing 64 of the lock cylinder has a piston rod 66 coupled to a dead bolt or other door lock, indicated in block diagram form at 68 in this figure. Upon the application of pressurized air by way of line 58 to the housing 64, the piston rod 66 of the lock cylinder 60 is shifted to unlock the lock 68. Conversely, when air pressure is removed from line 58, the door is locked because the rod 66 shifts to the lock position. The flow of air in line 54 is typically controlled, as by a needle valve 70 shown in this figure. With solenoid valve 56 in the position shown in FIG. 2, a vent position, the line 58 is coupled by way of a flow path 72 through the valve 56 and a line 74 to the atmosphere 76. Exhaust mufflers may be provided at each atmospheric vent location for noise reduction purposes. Conversely, when valve 56 is shifted to the door unlock position, pressurized air from supply 50 is coupled through the line 54 and a flow path 78 of valve 56 to the line 58 and thus to the lock cylinder for purposes of unlocking the door.

The source of pressurized air at 50 is also coupled by a line 80 through a pressure regulator 82, a line 84, a first branch line 86 to a solenoid controlled valve 88 and a second branch line 90 to a solenoid controlled valve 92. The valve 88 controls the opening of the door at slow speed while the valve 92 controls the closing of the door at slow speed. These valves also control the delivery of pressurized air to the respective sides of the piston 32 of the drive cylinder 20. The valve 88 is coupled by a flow path 94 and a line 96 to the piston side 36 of the drive cylinder 20. Similarly, the valve 92 is coupled by a line 98 and a line 100 to the piston side 38 of the drive cylinder 20. Another solenoid controlled valve 102 is coupled by a line 104 to the line 96 and thus to the drive cylinder 20. The valve 102 is used to increase the velocity of the door as it opens. Also, another solenoid controlled valve 106 is coupled by an air flow line 108 to the line 100 and thus to the drive cylinder. The valve 106 is used to increase the velocity of the door as it closes. When in the position illustrated in FIG. 2, the door is stationary. In this case, the source of pressurized air is applied through the valve 88 by way of a flow path 110 and to the drive cylinder. Similarly, the pressurized air is supplied through the valve 92 by way of a flow path 112 and to the drive cylinder. Thus, under this steady state condition where the door is stationary, both sides of the drive cylinder are pressurized and the pressure differential across the piston 32 is eliminated. Furthermore, the drive cylinder is in effect primed with pressurized air for operation, as explained below, with any time delay associated with the delivery of pressurized air to the respective sides of the cylinder for purposes of moving the door being virtually eliminated.

In the event the valve 88 is shifted to the left in FIG. 2, line 94 is coupled by a flow path 114 to a line 116 and to atmospheric pressure 76. A variable flow restrictive orifice, such as an adjustable needle valve or choke 118 restricts the flow of air along this flow path. Under these conditions, the valve 88, by way of flow path 114, provides an air bleed flow path for bleeding air at a relatively slow rate from side 36 of the cylinder housing 30. This air bleed flow path includes lines 94, 96, 114, 116 and the choke 118. In the same manner, if the valve 92 is shifted to the left in FIG. 2, an air bleed flow path 120 is provided through this valve to a line 122, a variable restrictive orifice 124 and to the atmosphere 76. When in this latter position, an air bleed flow path from the piston side 38 of the cylinder housing 30 is provided by way of lines 98, 100, 120, 122 and the choke 124. This latter air bleed flow path permits the relatively slow bleeding of air from the piston side 38 of the cylinder through this path.

When in the position shown in FIG. 2, the flow of air through the valves 102 and 106 is blocked. However, upon shifting of the valve 102 to the left in FIG. 2, an air bleed flow path is provided because line 104 is coupled by an air flow path 130 through the valve 102 to a line 132 and then to the atmosphere 76. Similarly, when valve 106 to is shifted to the left in FIG. 2, an air bleed path is provided through an air flow path 134 of valve 106 to a line 136 and to atmosphere 76. Although they optionally may be provided with controllable restrictors to control maximum door speed, it should be noted that the illustrated respective lines 132 and 136 are not provided with restrictive orifices or chokes. Thus, the air bleed flow path including the lines 132 and 136 are effectively sized to be greater in cross sectional dimension than the flow paths through the respective lines 116 and 122. Consequently, when valves 102 or 106 are shifted to permit the bleeding of air from the drive cylinder housing therethrough, rapid air bleeding takes place. Therefore, the pressure at the associated sides of the drive cylinder drops rapidly and permits the rapid acceleration of the door in the event the opposite side of the piston is pressurized. Also, the noise associated with bleeding air through a choke is reduced to the extent the air passes through valves 102 and 106. Thus, in accordance with this construction, plural air bleed flow paths are provided for selective coupling to the cylinder housing at the respective sides 36 and 38 of the drive cylinder.

Assume the door is to be closed. This is accomplished by opening the air bleed path through the valve 106 in conjunction with opening the air bleed path through the valve 92. In this case, a relatively rapid pressure drop occurs at piston side 38 of the drive cylinder. Since the piston side 36 is pressurized by way of valve 88 coupling the piston side 36 to the air supply 50, rapid movement of the door toward the closed position takes place. As the door approaches the closed position, the air bleed path through valve 106 is shut off by shifting this valve. This reduces the rate of bleeding of air from side 38 and reduces the velocity of the door as it approaches the closed position. The velocity of the door following the shutting off of valve 106 is regulated by the rate air bleeds through the valve 92 by way of the air bleed flow path including the line 120 and orifice 124.

The system is operable in much the same manner when the door is shifted to the open position. That is, to open the door, the valve 102 is shifted to provide an air bleed path through the line 130 to rapidly bleed pressurized air from the piston side 36 of the drive cylinder. At the same time, valve 88 may be shifted to provide an air bleed path by way of line 114 and the restrictive orifice 118. Pressurized air rapidly escapes from side 36 of the drive cylinder by way of flow path 130 so that, due to the pressure applied to side 38 of the piston 32, the door velocity is relatively rapid. As the door approaches the open position, the valve 102 is shifted to shut off the air bleed path through the line 130. In this case, the door velocity is reduced and is controlled by the rate air is bled through the restrictive orifice 118.

Thus, the velocity of the door is reduced as the door approaches either of the open and the closed positions. By eliminating the valve 102, or alternatively the valve 106, the velocity of the door is still reduced, but only as it approaches one of the open and closed positions.

It should also be noted that the door may be stopped in any position by simply returning the valves to the state shown in FIG. 2. Also, the direction of travel of the door may be rapidly changed, with the door almost immediately travelling in the reverse direction at substantially the same rate as would be the case if the door did not change directions.

It should be appreciated that other mechanisms may be used to vary the rate of bleeding of air from the respective sides of the drive cylinder 20. For example, a controllable orifice may be used which is operable to restrict the size of the bleed flow path as the door approaches either the open position, the closed position or both. Thus, any suitable mechanism for varying the air bleed rate may be included within the present invention, although the use of plural valves and plural air bleed paths at the respective opposite sides 36, 38 of the piston 32 constitutes one preferred way of accomplishing this result.

The electrical schematic diagram of FIG. 3 will be described in connection with a description of the operation of the illustrated embodiment of the present invention. In FIG. 3, the condition of the limit switches associated with the circuit are shown with the door in a closed position and fully locked.

Figure 3:
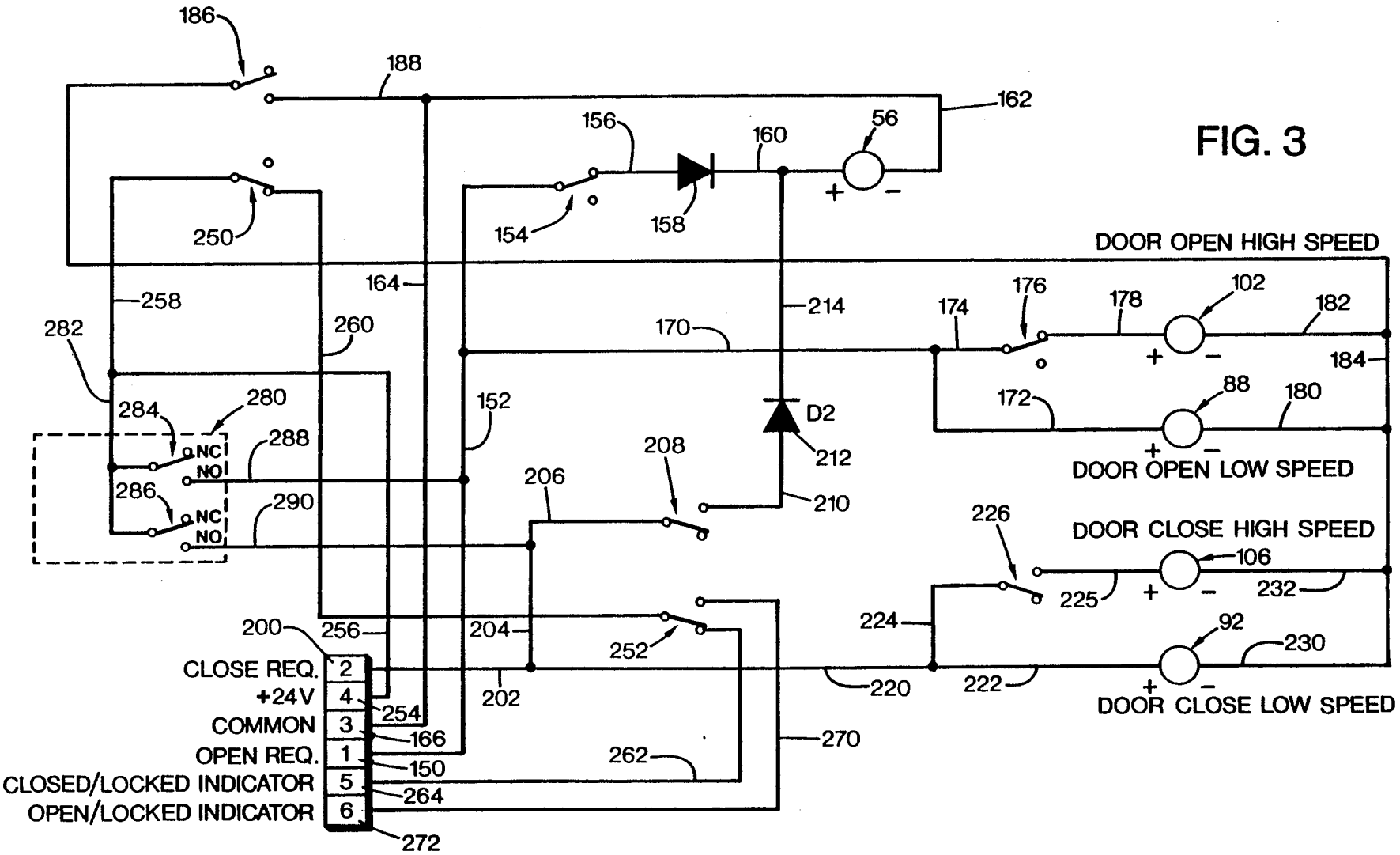
FIG. 3 is an electrical schematic diagram of one form of electrical circuit utilized in one embodiment of the present invention.

To open the door from the closed and locked position, a 24 volt dc control signal is applied to an open door request terminal 1, indicated at 150 in FIG. 3. This control signal is fed by a line 152 through a closed limit switch 154, a line 156, a diode 158 and a line 160 to the lock open solenoid valve 56. The limit switch 154 comprises a door open limit switch, which is closed as shown in FIG. 3 until the door reaches the fully open position. The solenoid valve 56 is grounded by way of lines 162 and 164 to a common terminal 3, indicated at 166 in FIG. 3. When solenoid valve 56 is energized, pressurized air is delivered through the valve 56 (by way of flow path 78 and line 58 to the lock cylinder 60 FIG. 2) to cause the door to unlock.

The control signal from line 152 is also applied by way of a line 170 and a line 172 to the solenoid valve 88. In addition, the control signal is applied by way of line 170 to a line 174, a door close speed reducing limit switch 176 and a line 178 to the solenoid valve 102. The grounded side of the solenoid valves 88 and 102 are coupled by respective lines 180, 182 to a line 184 and then to one side of an open lock position sensing limit switch 186. The other terminal of limit switch 186 is coupled by a line 188 to the line 164 and thus to ground terminal 166. Although not shown, the limit switch 186 is coupled to the lock 68 (FIG. 2) for detecting whether the lock is locked or unlocked. Because in FIG. 3 the lock is locked, the limit switch 186 is open and the solenoid valves 88, 102 remain deenergized. When the door lock is fully unlocked as a result of the energization of valve 56, limit switch 186 shifts and the circuit including the respective solenoid valves 88 and 102 is completed. With reference to FIG. 2, when valves 88 and 102 are energized, air is bled from side 36 of piston 32 and the door begins to open. As previously explained, energization of the valve 88 shifts this valve from an air supply position to an air bleed position. However, pressurized air is supplied to side 38 of the drive cylinder by way of the valve 92 such that the piston 32, and thereby the door, is moved toward the open position. As the door approaches the open position, and in this specific embodiment as the door approaches a predetermined distance from the full open position, such as about eight inches from being fully open, the speed reducing limit switch 176 is contacted by the switch actuating bar 40 (FIG. 1) and opens the circuit to solenoid valve 102. When this happens, the air bleed path through valve 102 is shut off and the door slows down. Due to the small amount of exhaust air still being bled by way of valve 88, the door slows almost to a stop by the time it reaches a full open position. Consequently, noise and jarring associated with the impact of a door against a jamb or stop is minimized.

When the door is fully open, the door open limit switch 154 is activated to open the circuit to valve 56 such that the lock (FIG. 2) begins to move to its lock position. As the door locks, the limit switch 186 again opens the circuit between lines 184 and 188 and thereby deenergizes the solenoid valve 88. When the solenoid valve 88 is deenergized, pressurized air is delivered to side 36 of the drive cylinder (FIG. 2) by way of the flow path 110 through the solenoid valve 88. Simultaneously, pressurized air is also being delivered to the valve 92 by way of flow path 112. Therefore, both sides 36 and 38 of piston 32 are subjected to air under pressure, with the pressure being equal at such sides so that no force is applied to the door.

At any time during the door opening procedure the control signal may be removed to stop the door at an intermediate position. The door may then subsequently be opened further by reinstating the control signal to terminal 150 of the circuit or subsequently closed further by applying a signal to a close request terminal 200 as explained below.

Next assume that it is desired to close the door from the previously described stopping point, that is with the door in the open and locked position. In this case, a 24 volt dc control signal is applied to the close request terminal 2, indicated at 200 in FIG. 3. This control signal is coupled by lines 202, 204, 206, a limit switch 208, line 210, a diode 212 and a line 214 to the valve 56. The circuit through the limit switch 208 is closed under these conditions because it was shifted to the closed position by the limit switch actuating bar 40 (FIG. 1) when the door commenced opening from the fully closed position. As previously explained, under these conditions the valve 56 delivers pressurized air to the lock and causes the lock to open. In addition, the limit switch 186 completes the circuit between the lines 188 and 184 when the lock is unlocked. The control signal on line 202 is also fed by a line 220 and a line 222 to the solenoid valve 92. Similarly, this control signal is coupled from line 220 by a line 224 and through a high speed door close limit switch 226 to the solenoid valve 106. Limit switch 226 was shifted to complete the circuit between lines 224 and 225 when the door opened a predetermined distance, e.g. eight inches, from the closed position. The respective solenoid valves 92, 106 are coupled by lines 230, 232 to the line 184 and thus to the limit switch 186. Therefore, after the lock has been unlocked in response to energization of solenoid valve 56 and the limit switch 186 has completed the circuit between lines 184 and 188, the solenoid valves 92 and 106 are energized.

With reference to FIG. 2, upon energization of valves 92 and 106, these valves shift to provide air bleed paths by way of respective lines 120 and 134 through these valves. Simultaneously, air under pressure is applied by way of valve 88 to the side 36 of piston 32 such that the piston begins to shift and cause the door to close. As the door approaches the closed position, in this case when the door reaches a predetermined distance from the closed position, such as about eight inches, the limit switch 226 is actuated so as to open the circuit path between lines 224 and 225. This deenergizes the valve 106 and shuts off the air bleed path through this valve. Consequently, the door slows down as it approaches the closed position. Due to the small amount of air being bled through the valve 92 under these conditions, the door slows almost to a stop by the time it reaches the fully closed position. When the door is fully closed, the limit switch 208 is opened so as to open the circuit path between lines 206 and 210. This deenergizes the valve 56 and, as previously discussed in connection with FIG. 2, the lock begins to shift to a locked position. As the door begins to lock, limit switch 186 is released and the circuit between lines 184 and 188 opens to thereby deenergize the solenoid valve 92. When solenoid valve 92 is deenergized, as shown in FIG. 2, pressurized air is supplied through this valve by way of line 112 to the side 38 of the drive cylinder. Simultaneously, pressurized air is also applied to the side 36 of the drive cylinder such that pressure on both sides of the piston 32 is the same and no force is applied to the door.

The circuit of FIG. 3 also has a number of door and lock position indicators. In particular, when the door is in the closed and locked position, a pair of limit switches 250 and 252 are operated to complete a closed/locked indicator circuit. This circuit extends from a 24 volt dc voltage applied to a terminal block 4, indicated at 254 in FIG. 3, a line 256, a line 258, through limit switch 250, a line 260, the limit switch 252, and a line 262 to a closed/locked indicator terminal 5, indicated at 264 in FIG. 3. The terminal 264 is typically coupled to indicator lights or other alerting devices at a remote control station to provide visual, auditory, and/or other signals confirming the closed/locked condition of the door. When the door unlocks, the limit switch 250 opens the circuit between lines 258 and 260, thereby causing the indicator to stop indicating that the door is in a locked condition. Furthermore, as the door moves from the fully closed position, the limit switch 252 is also shifted to open the circuit between lines 260 and 262. More specifically, limit switch 252 shifts to a position coupling the line 260 to a line 270 and to an open/locked indicator terminal 6, numbered as 272 in FIG. 3. After the door has reached its fully open position and the lock is shifted to its locked position as previously explained, the limit switch 250 again closes. However, in this case, because line 252 has shifted, an open/locked indicator circuit is completed through the limit switch 252 and line 270 to the terminal block 272. The terminal block 272 may be coupled to a remote control panel for providing visual, auditory, and/or another indication that the door is in the open/locked position. Of course, the indicators may be wired to separately indicate whether the door is locked, closed or open.

In addition, an optional override circuit is provided as indicated generally at 280 in FIG. 3. The override circuit includes a line 282 coupled to the node between lines 256 and 258 and to respective limit switches 284 and 286. When limit switch 284 is closed, a circuit is completed from line 284 by way of a line 288 and to the line 152. Under these conditions, the 24 volt dc voltage from terminal 4 is coupled by way of lines 256, 282, limit switch 284 and line 288 to the line 252. This causes the door to operate in the same manner as if a door open request control signal had been applied to terminal 1 of the circuit. Similarly, to close the door, the limit switch 286 is shifted to complete a circuit path between line 282 and a line 290 to the line 204. Under these conditions, the circuit behaves as if a closed request 24 volt dc signal had been applied to terminal 2 to initiate the door closing sequence.

Typically the switches 284 and 286 are key actuated and are located, for example, in a penal institution application adjacent to but outside of the door to be controlled. Thus, a corrections officer may simply use a key to open or close the door at the door location. Therefore, both remote control of the door, by way the signals delivered to terminals 1 and 2 from, for example, a control panel and local control of the door operation may be achieved.

Having illustrated and described the principals of my invention with reference to a preferred embodiment, it should be apparent to those of ordinary skill in the art that the invention may be modified in arrangement and detail without departing from such principals. For example, the door control signals at terminals 1 and 2 of FIG. 3 may be provided from any convenient source. These signals may be manually generated or may be semi-automatic or automatic. For example, signals causing the doors to open may be provided automatically in a retail store environment in response to the detection of a person approaching the door. I claim as my invention all modifications which fall within the scope of the following claims.

I claim:

1. A door apparatus comprising;

a wall structure defining a door opening;

a door;

a door support, the door support slidably mounting the door to the wall structure for shifting between a first open position in which the door opening is open and a second closed position in which the door opening is closed by the door;

a fluid actuator coupled to the door and wall structure, the fluid actuator being operable to shift the door between the open and closed positions, the fluid actuator also being operable to abruptly reverse the direction of shifting the floor from an opening direction and toward a closing direction without the door reaching the open position and regardless of the position of the door, the fluid actuator reducing the velocity of the door as the door approaches at least one of the open and closed positions;

an apparatus in which the fluid actuator comprises a fluid cylinder having a housing and a piston therein, the fluid cylinder being coupled to the door and to the wall structure such that movement of the piston within the housing shifts the door between the first open and second closed positions in response to a fluid pressure differential across the piston, the apparatus being operable to reduce the rate of movement of the piston to reduce the velocity of the door as the door approaches at least one of the open and closed positions; and the piston having first and second sides across which a fluid pressure differential is established to shift the door between the first and second positions, both sides of the piston being subjected to elevated fluid pressure relative to atmospheric pressure when the door is stationary regardless of the position of the door at the open position, the closed position or an intermediate position between the open and closed positions.

2. A door apparatus comprising:

a wall structure defining a door opening;

a door;

a door support, the door support slidably mounting the door to the wall structure for shifting between a first open position in which the door opening is open and a second closed position in which the door opening is closed by the door;

a fluid actuator coupled to the door and wall structure, the fluid actuator being operable to shift the door between the open and closed positions, the fluid actuator reducing the velocity of the door as the door approaches at least one of the open and closed positions;

the fluid actuator comprising a pneumatic cylinder having a housing and a piston therein, the piston having first and second sides, the pneumatic cylinder being coupled to the door and to the wall structure such that movement of the piston within the housing shifts the door between the first and second positions in response to a fluid pressure differential across the piston with the direction of travel of the door being changeable from an opening direction toward the open position and toward the closed position when the door is between the first and second positions, the apparatus including means for reducing the rate of movement of the piston to reduce the velocity of the door as the door approaches at least one of the open and closed positions;

the apparatus including an air bleed from which air is selectively bled or exhausted from the housing at one side of the piston and a source from which air under pressure is delivered to the housing at the other side of the piston, thereby resulting in a pressure differential across the piston to shift the door toward at least one of the open and closed positions, the air bleed reducing the rate at which air is bled from said one side of the piston as the door approaches said at least one of the open and closed positions; and the source of air under pressure being delivered at an elevated air pressure relative to atmospheric pressure to both the first and second sides of the piston simultaneously when the door is stationary.

3. An apparatus according to claim 2 in which the source of air under pressure delivers pressurized air of equal elevated pressure relative to atmospheric pressure to the housing at both sides of the piston while the door is not moving.

4. An apparatus according to claim 2 in which the source of air pressure delivers pressurized air of equal elevated pressure relative to atmospheric pressure to the housing at both sides of the piston while the door is in either of the open or closed positions.

5. An apparatus according to claim 2 in which the fluid actuator is responsive to control signals from a control panel at a location remote from the door opening to shift the door between open and closed positions.

6. An apparatus according to claim 2 in which the pneumatic cylinder has first and second air bleed flow paths communicating with the housing at a first side of the piston and first and second air bleed flow paths communicating with the housing at the second side of the piston, the air bleed comprising a valve operable independently of the piston for selectively opening at least one of the first and second air bleed flow paths at one side of the piston to increase the velocity of the door toward the open or closed position and for selectively closing at least one of the air bleed flow paths at said one side of the piston to decrease the velocity of the door as the door approaches the open or closed positions.

7. An apparatus according to claim 6 wherein:

the valve means comprises means for opening both of the air bleed flow paths at said one side of the piston to increase the velocity of the door; and when the direction of travel of the door is changed between the first and second positions, the valve means comprising means for bleeding the pneumatic cylinder so the door travels in a reverse direction at substantially the same rate as would be the case if the door did not change directions.

8. An apparatus according to claim 7 in which the valve means comprises means for leaving one of the first and second air bleed flow paths open while closing the other of the first and second air bleed flow paths to reduce the velocity of the door.

9. An apparatus according to claim 7 in which the first and second air bleed flow paths are of a different cross sectional area.

10. A door apparatus comprising:

a wall structure defining a door opening;

a door mounted in the door opening for shifting between a first open position and a second closed position;

a pneumatic actuator coupled to the door and wall structure for shifting the door between the open and closed positions, the actuator comprising a cylinder having a housing and a piston movable therein, the piston having first and second sides, the actuator being coupled to the door and wall structure such that extension of the actuator by moving the piston in one direction within the housing shifts the door toward one of the open and closed positions and retraction of the actuator by moving the piston within the housing in a direction opposite to the one direction shifts the door toward the other of the open and closed positions; and a pressurized air source coupled to the housing at both side of the piston to supply air at an elevated pressure relative to atmospheric pressure to both sides of the housing simultaneously when the door is in a stationary position.

11. A door apparatus according to claim 10 including a vent which is selectively coupled to the housing at the first and second sides of the piston to selectively relieve the air pressure at the first and second sides of the piston to allow the shifting of the door between the open and closed positions.

12. A door apparatus according to claim 11 in which the vent includes means for reducing the rate air is vented as the door approaches the open or closed positions.

13. A door apparatus according to claim 12 in which the vent is operable to vent air from a first side of the piston as the door is shifted toward the open position, the vent for venting air at a first rate from the first side of the piston and at a second rate slower than the first rate upon the door reaching a first predetermined distance from the open position, the vent being operable to vent air from a second side of the piston as the door is shifted toward the closed position, the vent venting air at a third rate from the second side of the piston and at a fourth rate slower than the third rate upon the door reaching a second predetermined distance from the closed position, the vent venting air from the first side of the piston at a rate in excess of the second rate upon reversal of the direction of travel of the door toward the open position and prior to the door reaching the first predetermined distance, and the vent means comprising means for venting air from the second side of the piston at a rate in excess of the fourth rate upon reversal of travel of the door toward the closed position and prior to the door reaching the second predetermined distance, whereby between the first and second predetermined distances the rate of travel of the door may be abruptly changed.

14. An apparatus according to claim 13 wherein:

the rate of venting upon reversal of the direction of travel of the door toward the open position is the first rate until the first predetermined distance is reached and the rate of venting upon reversal of the direction of travel of the door toward the closed position is the third rate until the second predetermined distance is reached.

15. An apparatus according to claim 14 in which the first and third rates are the same.

* * * * *

UNITED STATES PATENT AND TRADEMARK OFFICE

CERTIFICATE OF CORRECTION

PATENT NO. : 5,269,098

DATED : December 14, 1993

INVENTOR(S) : Carl E. Redman

It is certified that error appears in the above-indentified patent and that said Letters Patent is hereby corrected as shown below:

Column 10, line 44, "floor" should be --door--.

Signed and Sealed this

Seventh Day of March, 1995

*Attest:*

*Attesting Officer*

BRUCE LEHMAN

*Commissioner of Patents and Trademarks*